US005465664A

United States Patent [19]

Fey

[11] Patent Number: 5,465,664

[45] Date of Patent: Nov. 14, 1995

[54] FUEL AND EXPLOSIVE COMPOSITION WITH FERRIC OR CUPRIC ION AND REDUCING SUGARS

[76] Inventor: Warren O. Fey, 11092 E. Harvard Dr., Aurora, Colo. 80014

[21] Appl. No.: 55,545

[22] Filed: May 3, 1993

[51] Int. Cl.[6] ..... C06D 5/06

[52] U.S. Cl. ..... 102/290; 149/60

[58] Field of Search ..... 149/60; 102/290

[56] References Cited

U.S. PATENT DOCUMENTS

| | | | |
|---|---|---|---|
| 2,965,466 | 12/1960 | Ball | 52/5 |
| 2,999,744 | 9/1961 | Eckels | 52/5 |
| 3,050,423 | 8/1962 | Hudson | 149/19 |
| 3,333,998 | 8/1967 | Ferguson | 149/21 |
| 3,477,888 | 11/1969 | Yanagisawa | 149/18 |
| 3,507,718 | 4/1970 | Mortenson et al. | 149/3 |
| 3,791,255 | 2/1974 | Fox et al. | 149/92 X |
| 3,862,866 | 1/1975 | Timmerman et al. | 149/21 |
| 4,033,264 | 7/1977 | Bolza et al. | 149/60 X |
| 4,058,420 | 11/1977 | Barnhard et al. | 149/60 X |
| 4,077,820 | 3/1978 | Bolza et al. | 149/60 X |
| 4,427,465 | 1/1984 | Gonzalez | 149/2 |
| 4,528,049 | 7/1985 | Udy | 149/21 |
| 4,585,495 | 4/1986 | Honeyman et al. | 149/61 X |
| 4,722,757 | 2/1988 | Cooper et al. | 149/2 |
| 4,836,870 | 6/1989 | Cunningham et al. | 149/2 |
| 4,942,800 | 7/1990 | Bouillet et al. | 86/20.1 |
| 5,159,153 | 10/1992 | Cranney et al. | 149/60 X |

OTHER PUBLICATIONS

Sugar Chemistry, Shallenberger and Birch, 1975.
Handbook of Sugars, Junk and Pancoast, 1973.
Improvised Munitions Handbook, U.S. Army ™ 31–210, 1969.
Sucrose Chemicals, Kollonitsch, 1970.
Principles of Sugar Technology, Honig, 1959.
Principles of Sugar Technology, Honig, 1953.
Bioactive Carbohydrates, Kennedy.

*Primary Examiner*—Peter A. Nelson
*Attorney, Agent, or Firm*—Ray F. Cox

[57] ABSTRACT

This invention relates to fuels used in explosive, pyrotechnic, gas generating, and propellant compositions. The fuel composition of the present invention comprises the reaction products formed as a result of reacting a transition metal or transition metal compound, preferably ferric nitrate or ferric hydroxide with a reducing sugar. The fuel composition of the present invention is suitable for use in explosive compositions by mixing with an oxidizing agent. The fuel composition of the present invention and explosive compounds derived therefrom exhibit nonfouling and noncorrosive properties when used in firearms, along with greatly reduced residue.

34 Claims, No Drawings

FUEL AND EXPLOSIVE COMPOSITION WITH FERRIC OR CUPRIC ION AND REDUCING SUGARS

FIELD OF THE INVENTION

This invention relates to fuels used in explosive, pyrotechnic, gas generating, and propellant compositions. More specifically, this invention finds particular, but not exclusive, utility in compositions intended to replace Black Powder in all its applications.

BACKGROUND OF THE INVENTION

Explosive compositions must comprise a fuel and a source of oxygen. Oxygen is frequently supplied by nitrates, chlorates, permanganates, peroxides and other oxidizers, both organic and inorganic, known in the art. The fuel should comprise materials that can theoretically be oxidized completely and rapidly. Ideally, there should be very little residue remaining after the reaction takes place, with as much of the original material as possible being converted to heat energy and gases.

It is known in the art that the characteristics and performance of an explosive composition can be significantly altered by the use of various oxidizers, as well as various amounts of the oxidizer component, while the fuel component remains unchanged and, of course, vice-versa.

The primary examples of this type of composition are Black Powder and "Pyrodex". When Black Powder is burned, approximately 56% of the total weight remains as solid material. As is known to persons who use Black Powder in firearms, this residue causes fouling of the barrel, and repeated, unpleasant cleaning of the firearm. Many times the barrel must be swabbed out between shots. The presence of sulfur in Black Powder results in combustion products which, when combined with atmospheric moisture, cause corrosion of the barrel. While "Pyrodex" causes less fouling, it not only contains sulfur, but also contains potassium perchlorate, which results in the formation of soluble chloride salts. These salts are also corrosive to the barrel.

Historically, sucrose is known as a component of pyrotechnic compositions. Attempts have been made to produce gunpowder from sucrose and potassium chlorate, with unpredictable and disastrous results. Timmerman discloses, in U.S. Pat. No. 3,862,866, the use of sucrose and potassium chlorate in gas generating compositions. The sucrose is used in an unmodified and unreacted form; i.e., no degradation products are used. Other explosive compositions have been formulated which exhibit improved safety, performance, and other improved characteristics. These are described in the following U.S. Pat. Nos.:

4,497,676 - Kurtz

Gunpowder Substituted Composition and Method 4,728,376 - Kurtz

Explosive Composition and Method 4,881,993 - Fürbringer et al.

Explosive and Propellant Composition and Method of Preparation 4,964,429 - Beyeler et al.

Preparation of Explosives Containing Degradation Products of Ascorbic or Isoascorbic Acid 4,992,496 - Wehrli Fuel and Explosive Composition and Method of Making Same Application Ser. No. 07/851,753 - Fey Fuel and Explosive Composition and Method of Making Same The explosive compositions disclosed in these patents consist primarily of an organic acid fuel, usually ascorbic or erythorbic acid, and an inorganic nitrate oxidizer, usually potassium nitrate. While these compositions exhibit varying degrees of performance, they commonly exhibit non-fouling and non-corrosive properties when used in firearms, along with greatly reduced residue. The major drawback common to all the compositions disclosed in the above referenced U.S. patents is the cost of raw materials, and the instability of the raw materials market. In addition, many of these compositions exhibit unacceptable levels of hygroscopicity.

It is the principal object of the present invention to produce a fuel composition for use in explosive compositions. Such fuel exhibits improved performance, excellent binding and adhesive properties and greatly reduced cost and stability of the raw materials market. It is a further object of the present invention to produce a fuel composition well suited for use as a binder and or modifier in explosive, pyrothechnic, and propellant compositions.

It is a still further object of the present invention to produce an explosive composition comprising an improved fuel composition and an oxidizing agent. It is a further object of the present invention to use such improved fuel composition to form an explosive composition, which, when utilized as a gunpowder, evidences improved performance, including improved burn characteristics, with less residue, and producing greater velocities at pressures comparable to those produced by Black Powder and other existing gunpowder substitutes. A related object is to provide a method for making an improved fuel composition and a method for making an explosive composition in a safe and extremely cost effective manner, said explosive composition having the foregoing character and containing an improved fuel composition.

SUMMARY OF THE INVENTION

A significant aspect of the present invention relates to fuels formed from reducing sugars as a consequence of their ability to reduce many transition metal ions. When reacted with warm Fehling's solution a reducing sugar produces a red precipitate. The precipitate consists of a red copper oxide formed as a result of the reduction of the copper ions present. This is a standard test, used in the medical field, for the presence of glucose. Another significant and specific aspect of the present invention relates to a fuel formed as a result of a reaction of reducing sugars, and/or their degradation products, with an iron compound, the iron contained therein occupying a state that is capable of further reduction, such as the reduction from $Fe^{+++}$ to $Fe^{++}$. Yet another significant aspect of the present invention relates to a class of binders/modifiers suitable for use in explosive compositions formed as a result of reactions between reducing sugars and a transition metal or transition metal compound.

Another significant aspect of the present invention relates to an explosive composition comprising an oxidizing agent and the fuel formed as a result of reactions between a reducing sugar and a transition metal or transition metal compound, preferably iron or an iron compound. A further significant aspect of the present invention relates to a method for making a fuel suitable for use in an explosive composition by forming reaction products of reducing sugars and iron or iron compounds. A still further significant aspect of the present invention relates to a method for making an explosive composition by forming a fuel, comprising the reaction products of reducing sugars and an iron compound, degradation products of reducing sugars, and any remaining unreacted sugars, and mixing the fuel with an oxidizing agent.

DESCRIPTION OF THE PREFERRED EMBODIMENT

The fuel composition of the present invention comprises the reaction products formed as a result of reacting a transition metal or transition metal compound, preferably ferric nitrate or ferric hydroxide with a reducing sugar. It should be noted at this point that, although sucrose is not classed as a reducing sugar, it can be used as a raw material by merely subjecting it to a simple inversion process. A number of these processes are well known in the sugar industry. The use of different sugars or blends of sugars will provide different performance characteristics in the end product. The fuel may be prepared in an aqueous solution with the weight of $Fe(NO_3)_3 \cdot 9H_2O$ being approximately equal to 10% of the weight of the sugar. Such aqueous solution is evaporated at a temperature of 100°–110° C. The dried black residue produced comprises the reaction products which constitute the improved fuel composition of the present invention. A 3% solution of $H_2O_2$ may be used in place of water.

A stoichiometric quantity of base may be added to the solution to alter the pH of the solution and cause the production of $Fe(OH)_3$ pursuant to the following reaction:

$$Fe(NO_3)_3 \cdot 9H_2O + 3KOH \rightarrow Fe(OH)_3 + 3KNO_3 + 9H_2O$$

The presence of ferric hydroxide is desirable in this application due to the fact that these sugars are substantially degraded by the action of bases and the presence of degradation products is desirable. The resultant black color of the fuel is dependent either on the result of the reduction of the $Fe^{+++}$ ions and the subsequent colloidal particle oxide formation, which has the added advantage of being an excellent combustion catalyst, or the reaction of iron ions with phenol compounds produced as a consequence of the degradation of the sugars. This reaction is well known in the food industry.

The choice of the base used is dependent on the desired end use of the product. For instance, an acceptable product can be produced by the use of $NH_4OH$ in place of KOH. However, this results in ammonium nitrate being included in the final product. In many applications this is acceptable, but if the product is intended to be used as a propellant contained in brass cartridges, the ammonium nitrate can react with the copper present in the brass, forming tri-amino cupric nitrate. This is a sensitive, initiating explosive similar in activity to lead styphnate priming compound and is not desirable as a component of a propellant composition. The fuel composition thus produced has excellent adhesive properties and is suitable for use as a binder in explosive compositions. Adhesives produced by the reaction of sugars with metal compounds are known in the sugar industry. The term "binder" as used herein, includes binders and modifiers.

The explosive composition of the present invention comprises a mixture of an oxidizing agent, preferably a nitrate-containing inorganic oxidizer such as potassium nitrate, and the improved fuel of the present invention. The explosive composition thus produced has substantially enhanced physical and performance characteristics as well as very low cost. Laboratory methods used to obtain the improved fuel composition and the improved explosive composition are described below in Examples I through V. Methods used to obtain the improved fuel composition and the improved explosive composition which may be employed on a larger scale are described below also in Examples I through V.

EXAMPLE I

Approximately 100 grams of a reducing sugar, preferably fructose, are added to a 3% solution of $H_2O_2$ so as to create a saturated solution. A non-reactive vessel should be used, preferably glass or plastic. Approximately 10 grams of an $Fe^{+++}$ compound, preferably $Fe(NO_3)_3 \cdot 9H_2O$, are added to the solution, producing an amber colored solution. While stirring, slowly add 30% solution of $H_2O_2$ only until solution becomes colorless. The solution is then heated until the water is driven off and the temperature rises to 225° F. Drying is continued in an oven at 225° F. until a dark brown or black friable mass is formed. The material produced in this manner is suitable for use as the fuel component in explosive and/or deflagrating compositions. The fuel may be ground by any method which will yield the desired particle size. Those skilled in the art will appreciate that the performance characteristics of the end product are extremely dependent on the particle size. In this laboratory method, a small ball mill is used, and the desired particle size is on the order of 10 microns. When the fuel composition is to be used as a binder or modifier, the iron compound or other transition metal compound may be used in a ratio of up to an amount that is equimolar with the amount of the reducing sugar used.

To produce an improved explosive composition, the improved fuel and the oxidizer component, are mixed together in approximately stoichiometric amounts, based on the formula of the original sugar used. When $KNO_3$ is used as the oxidizer, the ratio of oxidizer to improved fuel composition is approximately 2:1 by weight. As is known in the art, differing performance characteristics desirable for different uses may be obtained by adjusting this ratio. As is also known in the art, the weight ratios will vary according to the type of oxidizer used. The mixing may be accomplished by any method suitable. In this laboratory procedure, the fuel and oxidizer components are ground separately in ball mills, either dry or in an ethanol slurry, and then thoroughly mixed. The fuel composition should not be triturated with chlorates, or any similarly sensitive oxidizing material. The explosive composition may be granulated and dried using any one of many techniques known in the art. In this method, the thoroughly mixed, dried components are slightly moistened and granulated and polished by tumbling or vibration. Any number of devices known to the candy industry will also fulfill this requirement. The polished granules should then be thoroughly dried and classified for size. With this fuel composition, a heat cure of approximately 225° F. is beneficial in terms of increasing the granular integrity and driving off any residual moisture.

EXAMPLE II

A fuel composition and an explosive composition similar to those obtained with the laboratory method described in Example I may be produced by preparing a saturated solution of sucrose in $H_2O_2$, adding $Fe(NO_3)_3 \cdot 9H_2O$ in an amount equal to approximately 10% of the weight of the sucrose and allowing the solution to sit for approximately 48–72 hours. The acidic condition causes partial inversion of the sucrose. Complete inversion of sucrose yields equimolar portions of glucose and fructose, both of which are reducing monosaccharides. From this point forward the method set forth in Example I should be followed.

EXAMPLE III

An improved explosive composition suitable for use as a detonating compound may be produced by substituting ammonium nitrate or a mixture of ammonium nitrate and potassium nitrate in place of potassium nitrate as the oxidizing agent of Examples I and II. Those skilled in the art will appreciate that the substitution of other oxidizing agents, such as the various chlorates, perchlorates, perborates, and permanganates, for example, for potassium nitrate as the oxidizing agent will also result in an improved explosive composition. The suitability of the improved explosive composition as a deflagrating, detonating, pyrotechnic, propellant, gas generating, or other type of explosive composition will depend, in part, on the choice of the oxidizing agent. Moreover, an appropriate ratio of fuel composition to oxidizing agent will vary depending upon the particular oxidizing agent employed and the stoichiometric relationships among the explosive composition constituents. For example, while a satisfactory weight ratio of improved fuel composition to potassium nitrate is approximately from 20:80 to 50:50, a preferable weight ratio of improved fuel composition to ammonium nitrate is approximately from 5:95 to 25:75.

The use of sucrose syrup with ammonium nitrate is disclosed in U.S. Pat. No. 4,427,465.

EXAMPLE IV

Prepare a solution of sugar, $H_2O_2$, and $Fe(NO_3)_3.9H_2O$ as described in Examples I and II. While stirring, add a stoichiometric amount, with respect to the amount of $FE(NO_3)_3.9H_2O$, of $NH_4OH$ solution until the solution turns dark brown. If any ammonia odor remains after a few minutes, there is an excess of $NH_4OH$ and the quality of the fuel is diminished. The drying time of the fuel is slightly longer.

This approach takes advantage of the non-enzymatic browning reactions, known as the Maillard reaction, well known in the food industry. In standard practice, in the food industry, amino acids are reacted, at elevated temperatures, with sugars. This procedure results in the formation of nitrogen containing, sugar-based compounds, as well as other degradation products of the sugar used. In non-food uses, many other amino compounds may be used in place of the amino acids. However, the inclusion of these products generally causes objectionable odors during manufacture and end use of the product, as well as an unnecessary increase in cost. Additionally, as discussed previously, the ultimate inclusion of ammonium nitrate in the end product becomes a possibility. In end uses where exposure to copper is likely, this is not desirable. Ammonium nitrate is also quite hygroscopic and therefore is also undesirable in many applications.

EXAMPLE V

Prepare the solution as described in example I. While stirring, add KOH solution. The molar ration of KOH to $Fe(NO_3)_3.9H_2O$ should be approximately 3:1. A reaction takes place which produces $Fe(OH)_3$ and $KNO_3$. The $Fe^{+++}$ is presumably reduced to $Fe^{++}$ and the formation of FeO results. The FeO formed in this manner occurs in very small particle size, presumably colloidal, and functions as a combustion catalyst in addition to degrading the sugar as the $Fe^{+++}$ is reduced to $Fe^{++}$. This solution is then treated in the same manner as the solution in Example I to obtain an improved fuel composition.

Again, the presence of the various degradation products of the sugar(s) is a very important element of the improved fuel composition. The formation of the degradation products is primarily affected by pH, temperature, and time. The type of product is primarily affected by pH. The rate of reaction is primarily affected by temperature, and the quantity of degradation products is primarily affected by time, when the other factors remain constant. In the case of degradation products produced by reacting the sugar(s) with other compounds, such as oxidizing agents, the nature of the degradation products is affected by the nature of the other compounds.

While the reducing sugars are able to reduce many other metallic ions, as well as iron, iron is preferred, based on cost, availability, and relative lack of toxicity. It is understood that other transition metal ions, such as copper, will fulfill the function performed by the iron, with consequent variations in characteristics and performance. The reduction, by the reducing sugars, of various metal ions is well known, and has been studied extensively in the sugar industry.

Presently preferred embodiments of the present invention have been described. It should be understood that this description has been made by way of preferred examples, and that the invention is defined by the scope of the following claims.

What is claimed is:

1. A fuel composition comprising:

(a) The reaction products of $Fe(NO_3)_3.9H_2O$ and a sugar selected from the group commonly known as reducing sugars, and (b) Degradation products of a sugar, and (c) Any remaining unreacted sugar.

2. A fuel composition as defined in claim 1 wherein the $Fe(NO_3)_3.9H_2O$ and the sugar are supplied in a molar ratio of up to 3:23.

3. A binder for use in explosive compositions comprising:

(a) The reaction products of $Fe(NO_3)_3.9H_2O$ and a sugar selected from the group commonly known as reducing sugars, (b) Degradation products of a sugar, and (c) Any remaining unreacted sugar.

4. A binder as defined in claim 3 wherein the $Fe(NO_3)_3.9H_2O$ and the sugar are supplied in a molar ratio of up to 1:1.

5. A fuel composition comprising:

(a) the reaction products of a compound of a transition metal ion selected from the group consisting of ferric ions and cupric ions and a sugar selected from the group commonly known as reducing sugars, (b) degradation products of the sugar, and (c) any remaining unreacted sugar.

6. The fuel composition of claim 5 wherein said transition metal ion is a ferric ion.

7. The fuel composition of claim 6 wherein the weight ratio of ferric ion to sugar is up to 3:100.

8. The fuel composition of claim 6 wherein said compound of a transition metal ion is $Fe(NO_3)_3.9H_2O$.

9. The fuel composition of claim 8 wherein the $Fe(NO_3)_3.9H_2O$ and the sugar are in a molar ratio of up to 3:23.

10. The fuel composition of claim 6 wherein said compound of a transition metal ion is $Fe(OH)_3$.

11. A binder for use in explosive compositions comprising:

(a) the reaction products of a compound of a transition metal ion selected from the group consisting of ferric ions and cupric ions and a sugar selected from the group commonly known as reducing sugars, (b) degradation products of the sugar, and (c) any remaining unreacted sugar.

12. The binder of claim 11 wherein said transition metal ion is a ferric ion.

13. The binder of claim 12 wherein the weight ratio of ferric ion to sugar is up to 3:100.

14. The binder of claim 12 wherein said compound of a transition metal ion is $Fe(NO_3)_3.9H_2O$.

15. The binder of claim 14 wherein the $Fe(NO_3)_3.9H_2O$ and the sugar are in a molar ratio of up to 3:23.

16. The binder of claim 12 wherein said compound of a transition metal ion is $Fe(OH)_3$.

17. An explosive composition comprising an oxidizer in admixture with a fuel composition comprising:

(a) the reaction products of a compound of a transition metal ion selected from the group consisting of ferric ions and cupric ions and a sugar selected from the group commonly known as reducing sugars, (b) degradation products of the sugar, and (c) any remaining unreacted sugar.

18. The explosive composition of claim 17 wherein said transition metal ion is a ferric ion.

19. The explosive composition of claim 18 wherein the weight ratio of ferric ion to sugar is up to 3:100.

20. The explosive composition of claim 18 wherein said compound of a transition metal ion is $Fe(NO_3)_3.9H_2O$.

21. The explosive composition of claim 20 wherein the $Fe(NO_3)_3.9H_2O$ and the sugar are in a molar ratio of up to 3:23.

22. The explosive composition of claim 18 wherein said compound of a transition metal ion is $Fe(OH)_3$.

23. The explosive composition of claim 19 wherein said oxidizer is selected from the group consisting of nitrates, chlorates, perchlorates, permanganates, and peroxides.

24. The explosive composition of claim 23 wherein said oxidizer is ammonium nitrate.

25. The explosive composition of claim 23 wherein said oxidizer is potassium nitrate.

26. The explosive composition of claim 25 wherein the weight ratio of the fuel composition to the potassium nitrate is from about 20:80 to 50:50.

27. The explosive composition of claim 21 wherein said oxidizer is selected from the group consisting of nitrates, chlorates, perchlorates, permanganates, and peroxides.

28. The explosive composition of claim 27 wherein said oxidizer is ammonium nitrate.

29. The explosive composition of claim 27 wherein said oxidizer is potassium nitrate.

30. The explosive composition of claim 29 wherein the weight ratio of the fuel composition to the potassium nitrate is from about 20:80 to 50:50.

31. The explosive composition of claim 22 wherein said oxidizer is selected from the group consisting of nitrates, chlorates, perchlorates, permanganates, and peroxides.

32. The explosive composition of claim 31 wherein said oxidizer is ammonium nitrate.

33. The explosive composition of claim 31 wherein said oxidizer is potassium nitrate.

34. The explosive composition of claim 33 wherein the weight ratio of the fuel composition to the potassium nitrate is from about 20:80 to 50:50.

* * * * *